US006293875B1

(12) United States Patent
Sanford

(10) Patent No.: US 6,293,875 B1
(45) Date of Patent: Sep. 25, 2001

(54) GOLF SWING TRAINING AID

(76) Inventor: James Robert Markus Sanford, P.O. Box 1408, Mauriceville, TX (US) 77626

( * ) Notice: Subject to any disclaimer, the term of this patent is extended or adjusted under 35 U.S.C. 154(b) by 0 days.

(21) Appl. No.: 09/294,198

(22) Filed: Apr. 20, 1999

(51) Int. Cl.[7] ..... A63B 69/36

(52) U.S. Cl. ..... 473/268; 473/223; 473/226; 473/204; 473/206

(58) Field of Search ..... 473/201, 204, 473/206, 218, 219, 223, 226, 231, 238, 266, 267, 268, 285, 286

(56) References Cited

U.S. PATENT DOCUMENTS 3,410,562 * 11/1968 LeFleur .
4,862,823 * 9/1989 Hughes .
5,230,511 * 7/1993 Gubany .
5,516,108 * 5/1996 Foster .
5,658,205 * 8/1997 Bartscherer .
5,759,111 * 6/1998 Clark .
5,941,780 * 8/1999 Marier .

* cited by examiner

*Primary Examiner*—William M. Pierce
(74) *Attorney, Agent, or Firm*—Locke Liddell & Sapp LLP

(57) ABSTRACT

A golf swing training aid permits the user to verify that the face of the golf club has not been inadvertently rotated during the back swing and/or the downswing. The golf swing training aid permits the user to confirm the rotation or lack of rotation of the golf club face without requiring lifting of the head and/or shoulders of the user.

8 Claims, 4 Drawing Sheets

GOLF SWING TRAINING AID

BACKGROUND OF THE INVENTION

This invention relates to sports training systems, and more particularly, to a golf swing training aid which enables the user to confirm that the golf club head is facing the proper direction (and has not been inadvertently rotated).

In swinging a golf club, it is important to first align the head of the golf club adjacent to the golf ball and with the face of the golf club head perpendicular to the desired direction of golf ball travel. This is commonly referred to as the "setup" or "addressing" the golf ball. Then, the golfer pulls the golf club away from the golf ball, in a combined rearward and upward direction, and this portion of the golf swing is called the "back swing". At the top of the back swing, (frequently called the full "take away" position)the golfer reverses the direction of golf club movement, and swings the club in a combined down and forward movement (the "downswing") into contact with the golf ball. It is preferred that the downswing actually retrace the path of the back swing for a consistent swing without the resultant golf ball path deviating from the desired direction of golf ball travel.

During all portions of the swing, it is important not to accidentally rotate the golf club head, because such rotation, if not corrected during a later portion of the swing, results in the club face not being "square" or perpendicular to the desired direction of travel. For example, if the "rear to front" portion of the downswing follows the same path as the back swing, but if the club head has been rotated, the result is a slice or a hook because the club face is not "square" to the direction of travel, as the club face contacts the ball, and this imparts rotation to the golf ball.

To overcome this problem, many golfers will lift their head (typically during the back swing or at the top of the back swing)to confirm the proper alignment of the club face. This type of golfer head movement, with or without concomitant shoulder movement, changes the path of the downswing resulting in one or more of several problems such as "topping" the ball, hitting behind the ball, unintentional "in to out" or "out to in" swings, changes in the direction of impact of the ball, and even a golf swing which results in no contact with the golf ball. Thus lifting the head of the golfer to view the alignment of the club face during the back swing and/or downswing is not desirable.

SUMMARY OF THE INVENTION

It is thus apparent that there is a need for a different type of golf training aid which enables the golfer to confirm the orientation of the golf club face without head and/or shoulder movement of the golfer.

The present invention accomplishes this and other objectives by providing a golf swing training aid which can be used during the back swing, at the top of the back swing, and/or during the downswing but which does not require movement of the head of the golfer. Thus the present invention avoids the problem of lifting the head of the golfer with the resulting undesirable change in the golf club swing.

The present invention provides an adjustable flag or alignment guide which can be viewed without movement of the head of the golfer and which confirms the position of the golf club face.

BRIEF DESCRIPTION OF THE DRAWINGS

The foregoing advantages of the present invention, together with other advantages which may be attained by its use, will become more apparent upon reading the following detailed description of the invention taken in conjunction with the drawings.

In the drawings, wherein like reference numerals identify corresponding components.

DETAILED DESCRIPTION OF THE INVENTION

Figure 1:
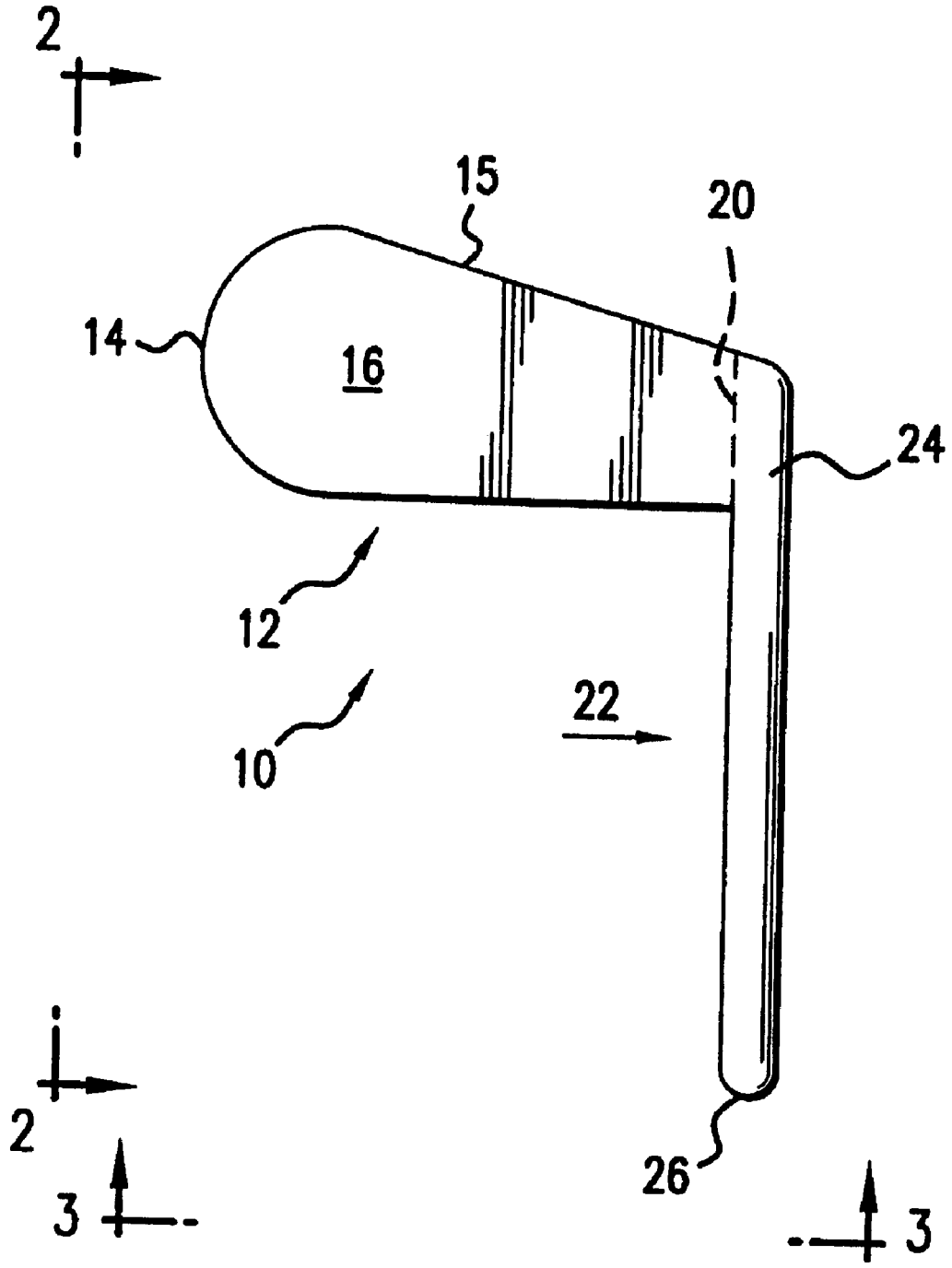
FIG. 1 is a front illustration of the golf swing training aid according to the principles of the present invention.
Figure 2:
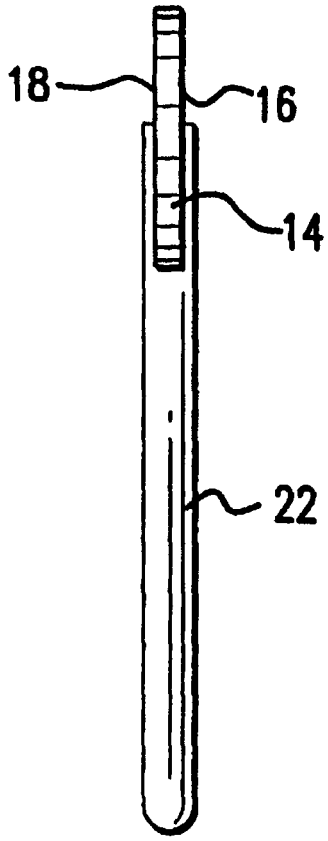
FIG. 2 is a side illustration of the golf swing training aid as seen in the direction of arrows 2—2 of FIG. 1.
Figure 3:
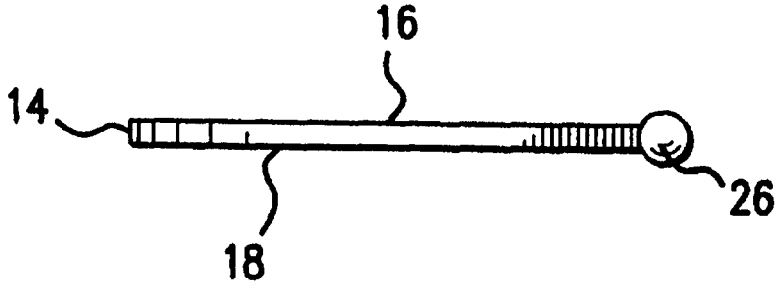
FIG. 3 is a plan illustration of the golf swing training aid as seen in the direction of arrows 3—3 of FIG. 1.

With reference to the drawings, a golf swing training aid 10 includes a flag or other indicator 12 which is preferably essentially planar. The flag 12 has an enlarged first edge or end 14, a top edge 15, and two opposed preferably planar faces 16, 18. The flag second end 20 is attached to a stem portion 22, at a first end 24 thereof. The stem is an elongated member of generally circular cross section, with the thickness generally tapering down toward a second end 26. As noted hereafter, however, planar faces are not required.

The swing training aid may be formed of metal, such as aluminum, or plastic, or other material having sufficient rigidity that the principles of the invention may be attained. In one embodiment, the flag portion is approximately 2.08 inches along the straight portion of the top as seen in FIG. 1, however it should be appreciated that all dimensions are provided merely for the purpose of explaining the invention. The straight bottom of the flag portion 12 is about 1.75 inches; the wide, first end 14 is about 1.025 inches and the narrower second end 20 of the flag is about 0.575 inches. The thickness of the flag portion 12 is about 0.080 inches, thus the opposed planar flag faces 16, 18 are spaced apart approximately 0.080 inches.

The stem 22 is approximately 3.0 inches in length and may be formed of the same material as the flag portion. The stem is of circular cross section, about 0.187 inch diameter. Thus the flag is slightly thinner, than the stem. If the flag and stem are made of metal, such as aluminum, the flag and stem may be welded together. For less costly manufacturing purposes the thickness of the flag may be the same as the diameter of the stem. The stem is tapered at one end, as previously noted, with the taper extending approximately one-third the length of the stem.

If the flag and stem are made of plastic, a single, unitary golf swing training aid may be formed such as by molding.

Figure 4:
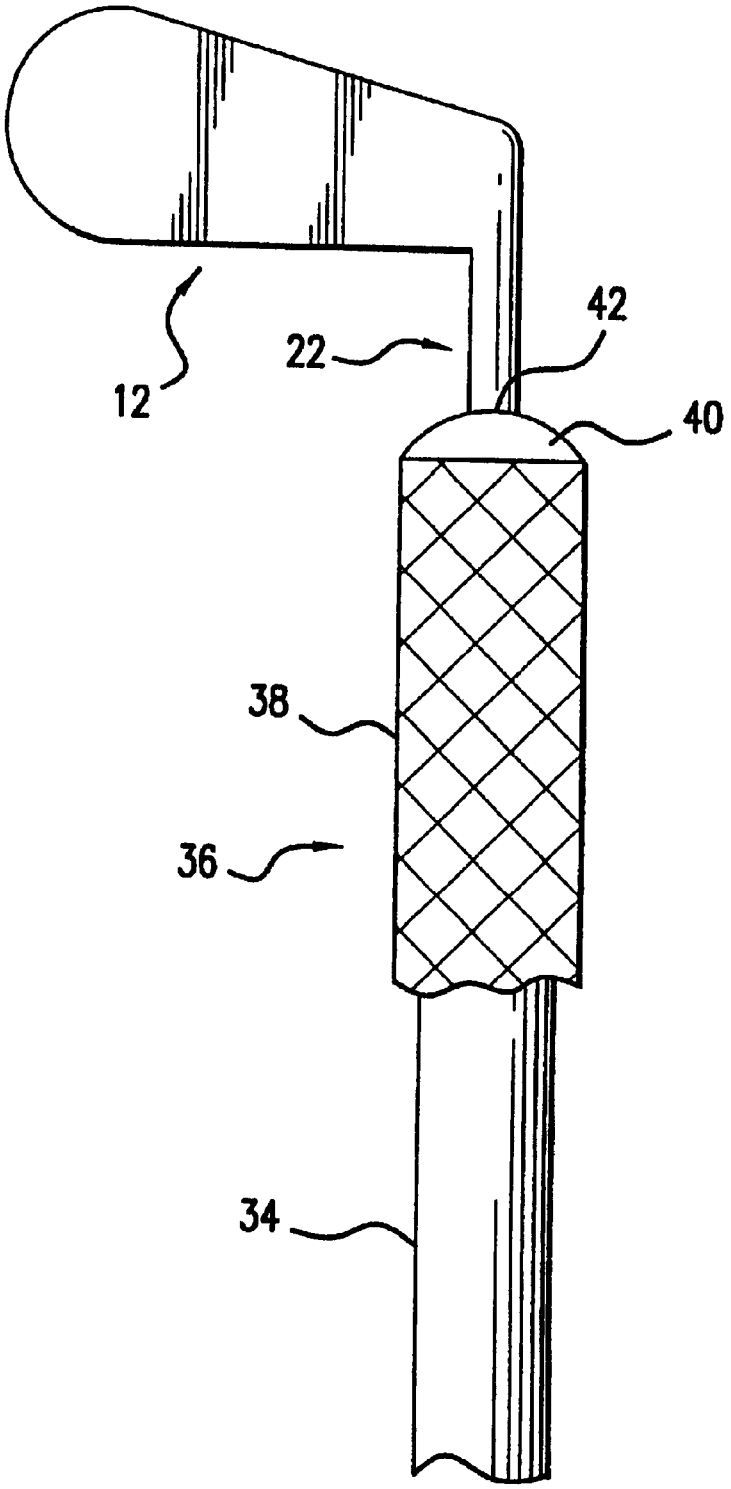
FIG. 4 is a partial illustration of the golf swing training aid positioned in the handle of a golf club.
Figure 5:
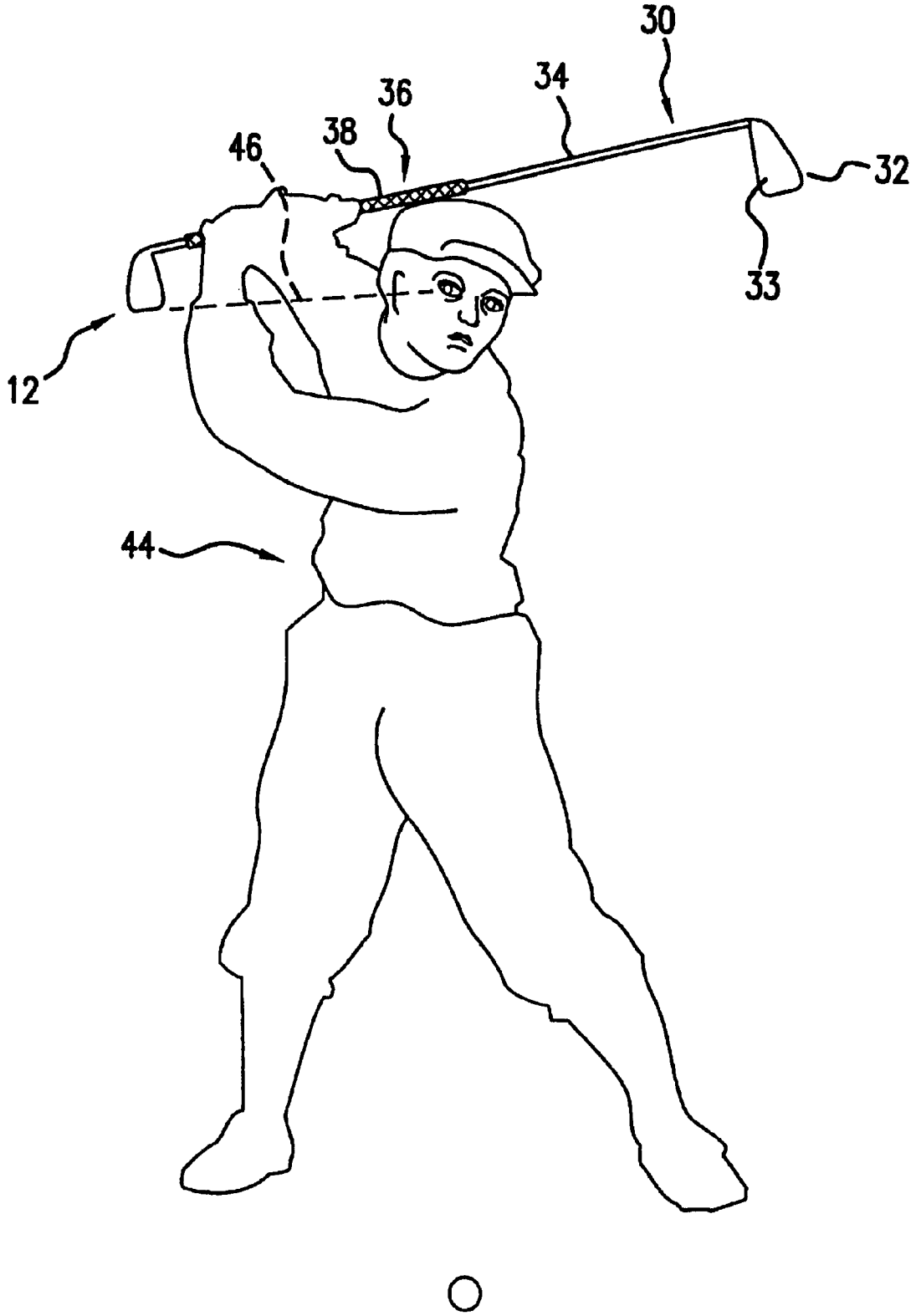
FIG. 5 is a schematic illustration of the use of the golf swing training aid according to the principles of the present invention.

Reference should be had to FIGS. 4 and 5 in which the use of the golf swing training aid of the present invention is illustrated and will now be described. A golf club 30 includes, as is conventional, a club head 32 having a face 33, and an elongated shaft 34 which is typically hollow. One end of the shaft is attached to the club head and the other end of the shaft terminates in a handle 36 which is covered with a material to form a gripping surface 38. The end of the hollow shaft is normally closed with a cap 40 having a vent hole 42.

According to the principles of the present invention, the thickness (or more specifically the diameter) of the stem 22 is of a size to be force-fit into the vent hole 42 of the golf club and frictionally retained therein. It is, of course, within the purview of the present invention that the cross-sectional configuration of the stem be round, flat, hexagonal, etc. The frictional fit is sufficient to secure the stem in the vent hole, yet allow for deliberate rotational movement of the stem relative to the golf club shaft for adjustment and alignment purposes. Specifically, the golf swing training aid is inserted into the vent hole of the golf club handle and is rotated so that the face of the flag portion is aligned coplanar to the face of the club head. The friction fit retains the flag in the desired position.

Then, the golfer 44 begins the back swing. At the top of the back swing, the golfer has a line of sight 46 to the flag of the training aid. The golfer should see only the front edge or first end 14 of the flag, and/or the top edge 15, but not either planar surface 16 or 18. If the golfer sees the first end 14 and/or the top edge 15, this indicates that there has been no rotation of the club face. On the other hand, if the golfer sees a planar surface 16 or 18, this indicates that there has been rotation of the club face during the back swing. As illustrated in the drawing, the line of sight 46 for the golfer does not require lifting of the head of the golfer.

As an alternative for alignment of the golf swing training aid relative to the golf club, the training aid may be rotated slightly in the handle of the club so that on the back swing, the golfer can see if the flag portion 12 is coplanar with the golfer's intended swing plane.

As yet another alternative, the golf swing training aid may be used in the handle of a putter, with the flag positioned and rotated to contact the wrist of the golfer—if the putting stroke is not correct, the golfer will immediately notice that the flag has moved out of contact with the wrist.

The present invention, as a golf swing training aid, may be modified without departing from the spirit and scope of the present invention. For example, the front and rear planar faces 16, 18 may be of different colors, different degrees of reflectiveness, different degrees of smoothness, different textures or different degrees of roughness, or any other difference so that the golfer, upon seeing one planar face, will know whether the golf club head and face have been rotated clockwise or counter-clockwise. In fact, the two faces need not be planar. The specific shape of the flag portion may be varied. Hollow tubes, or bushings, of rubber or plastic may be provided to accommodate vent holes which are larger in size (diameter) than the size (diameter) of the stem portion of the golf swing training aid.

Thus it should be appreciated that the foregoing is a complete description of the present invention but that many modifications may be made without departing from the spirit of this invention.

What is claimed is:

1. A golf swing training aid in combination with a golf club and for attachment to a top end of a said golf club, the golf club comprising (i.) at its bottom end a club head having a face, (ii) a handle and (iii) an elongated shaft, one end of the shaft being connected to the club head and the other end of the shaft terminating as the handle, the end of the handle being closed with a cap having a vent hole, wherein the training aid comprises an indicator portion and an elongated stem wherein:

(1) the indicator portion has (a) a first edge or end, (b) a top edge, (c) two opposed faces, and (d) a second end edge, the second end edge being attached to a first end portion of the elongated stem;

(2) the thickness of the stem tapering from the first end portion of the elongated stem to the second end edge of the stem;

(3) the second end edge of the stem being configured to be received into the vent hole of the golf club handle.

2. The golf swing training aid of claim 1, wherein the two opposed faces of the indicator portion are planar.

3. The golf swing training aid of claim 1, wherein the two opposed faces of the indicator portion are of different color.

4. The golf swing training aid of claim 1, wherein the two opposed faces of the indicator portion are of different reflectivity.

5. The golf swing training aid of claim 1, wherein the two opposed faces of the indicator portion are of different texture.

6. The golf swing training aid of claim 1, wherein the stem is configured to be rotatably mounted in the golf club handle.

7. The golf swing training aid of claim 1, wherein the stem is configured to be frictionally retained in the golf club handle.

8. The golf swing training aid of claim 1, wherein the indicator portion and the elongated stem are formed as a unitary device.

* * * * *